US011933576B1

(12) United States Patent
Pineda

(10) Patent No.: US 11,933,576 B1
(45) Date of Patent: Mar. 19, 2024

(54) HOPPER WITH LIGHT SOURCE FOR CHARGING PAINTBALLS

(71) Applicant: HK Army, Inc., Signal Hill, CA (US)

(72) Inventor: Jason Jeremiah Pineda, Signal Hill, CA (US)

(73) Assignee: HK Army Inc., Signal Hill, CA (US)

( * ) Notice: Subject to any disclaimer, the term of this patent is extended or adjusted under 35 U.S.C. 154(b) by 0 days.

(21) Appl. No.: 18/469,406

(22) Filed: Sep. 18, 2023

(51) Int. Cl.

| | |
|---|---|
| ***F41B 11/53*** | (2013.01) |
| ***F41B 11/71*** | (2013.01) |
| ***F42B 12/38*** | (2006.01) |
| ***F42B 12/42*** | (2006.01) |
| *F42B 12/40* | (2006.01) |

(52) U.S. Cl.
CPC ..... *F41B 11/71* (2013.01); *F41B 11/53* (2013.01); *F42B 12/38* (2013.01); *F42B 12/40* (2013.01)

(58) Field of Classification Search
CPC ..... F41B 11/52; F41B 11/53; F41B 11/57; F41B 11/70; F41B 11/71; F42B 12/38; F42B 12/42
USPC ..... 124/1, 45, 49, 51.1, 80, 82
See application file for complete search history.

(56) References Cited

U.S. PATENT DOCUMENTS

| | | | | |
|---|---|---|---|---|
| 5,415,151 | A * | 5/1995 | Fusi | F42B 12/38 124/16 |
| 5,762,058 | A * | 6/1998 | Cheng | F41A 21/32 124/83 |
| 6,298,841 | B1 * | 10/2001 | Cheng | F41A 21/32 102/501 |
| 6,481,432 | B2 * | 11/2002 | Rushton | F41B 11/53 124/49 |
| 7,004,813 | B2 * | 2/2006 | Zuloff | F41B 7/08 446/175 |
| 7,040,308 | B2 * | 5/2006 | Ciesiun | F41B 11/52 124/47 |
| 7,591,260 | B1 * | 9/2009 | Mu | F41B 11/57 124/51.1 |
| 7,870,851 | B2 * | 1/2011 | Mahany | F41B 11/68 124/56 |
| 7,966,999 | B2 * | 6/2011 | Bosch | F41B 11/57 124/51.1 |
| 8,596,255 | B2 * | 12/2013 | Meggs | F42B 6/10 124/56 |
| 8,640,683 | B2 * | 2/2014 | Meggs | F41B 11/641 124/56 |
| 9,297,605 | B2 * | 3/2016 | Spurlock | F41B 11/53 |
| 9,557,136 | B2 * | 1/2017 | Hedberg | F41B 11/53 |
| 10,488,146 | B2 * | 11/2019 | Quek | A63H 5/04 |
| 10,898,763 | B2 * | 1/2021 | Osborn | F21K 2/06 |
| 11,592,259 | B1 * | 2/2023 | Davis | F41B 7/006 |
| 11,662,187 | B1 * | 5/2023 | Pineda | F41B 11/57 124/41.1 |
| 2010/0126485 | A1 * | 5/2010 | Neumaster | F41A 19/01 124/51.1 |

(Continued)

*Primary Examiner* — Alexander R Niconovich
(74) *Attorney, Agent, or Firm* — Knobbe Martens Olson & Bear LLP

(57) ABSTRACT

A paintball hopper for a paintball gun with light source. The hopper can include a housing and a hopper tray. The hopper tray can be removably inserted into an inner volume of the hopper. The hopper can include a light source that can charge luminescent or glow in the dark material of paintballs in the hopper. The light source can be positioned in the housing and/or the hopper tray.

21 Claims, 9 Drawing Sheets

(56) References Cited

U.S. PATENT DOCUMENTS

| | | | | |
|---|---|---|---|---|
| 2013/0152912 | A1* | 6/2013 | Spencer | F41B 11/57 124/82 |
| 2014/0069406 | A1* | 3/2014 | Hastings | F41G 11/001 124/80 |
| 2023/0113213 | A1* | 4/2023 | Davis | G02B 27/20 124/71 |
| 2023/0221091 | A1* | 7/2023 | Davis | F42B 6/10 124/41.1 |

* cited by examiner

HOPPER WITH LIGHT SOURCE FOR CHARGING PAINTBALLS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to a hopper for a paintball gun, and more particularly to a hopper with a light source that can charge a paintball.

Description

Paintball guns or markers may be used for a variety of recreational and/or competitive games. Games with paintball guns or markers can be played both indoors and outdoors with teams of varying sizes. Many games are played in low-lighting conditions (e.g., at night or an arena with low lighting). To help players track the projectiles fired by them or by other players, the projectiles may be luminescent (e.g., glow in the dark). If the projectiles do not glow brightly enough, players will not be able to track their projectiles or spot the projectiles of other players.

SUMMARY

For purposes of this summary, certain aspects, advantages, and novel features are described herein. It is to be understood that not necessarily all such advantages may be achieved in accordance with any particular embodiment. Thus, for example, those skilled in the art will recognize the disclosures herein may be embodied or carried out in a manner that achieves one or more advantages taught herein without necessarily achieving other advantages as may be taught or suggested herein.

In accordance with one aspect of the disclosure, a system and method is provided for charging luminescent projectiles quickly and effectively throughout a paintball game session without having to exit the playing field or pause participation in a game.

In accordance with one aspect of the disclosure, a paintball hopper for a paintball gun can include a housing that can form an inner volume, and a hopper tray that can include an integrated light source configured to charge a luminescent material of paintballs in the inner volume of the housing. The hopper tray can be configured to removably couple to the housing so the hopper tray can be removably positioned in the inner volume.

In accordance with one aspect of the disclosure, at least a portion of the hopper tray can be transparent or semitransparent.

In accordance with one aspect of the disclosure, the hopper tray can include an electronic feed system.

In accordance with one aspect of the disclosure, the paintball hopper can include a power source configured to provide power to the integrated light source and/or the electronic feed system.

In accordance with one aspect of the disclosure, the paintball hopper can include a user interface configured to control one or more functions of the integrated light source and/or one or more functions of the electronic feed system.

In accordance with one aspect of the disclosure, the hopper tray can include a recess in a top surface and a conduit extending through the hopper tray from the recess to a bottom of the hopper tray.

In accordance with one aspect of the disclosure, the integrated light source can be positioned in the recess.

In accordance with one aspect of the disclosure, the integrated light source can include one or more LEDs, UV LEDs, or lasers.

In accordance with one aspect of the disclosure, the paintball hopper can include one or more light windows positioned over the integrated light source.

In accordance with one aspect of the disclosure, the paintball hopper can include one or more sensors configured to detect when the paintball gun is being used, and circuitry in communication with the sensor and the integrated light source can be configured to control one or more functions of the light source when the sensor detects the paintball gun is being used.

In accordance with one aspect of the disclosure, a hopper tray for a paintball hopper can include a recess extending into the hopper tray from a top surface; a conduit extending through the hopper tray from the recess to a bottom of the hopper tray; and a light source configured to charge a luminescent material of paintballs in the paintball hopper, wherein the hopper tray can be configured to removably couple to the paintball hopper so the hopper tray can be removably positioned in an inner volume of the paintball hopper.

In accordance with one aspect of the disclosure, at least a portion of the hopper tray can be transparent or semitransparent.

In accordance with one aspect of the disclosure, the light source can be positioned in the recess.

In accordance with one aspect of the disclosure, the hopper tray can include an electronic feed system configured to direct paintball in the recess towards the conduit.

In accordance with one aspect of the disclosure, the hopper tray can include a sensor configured to detect when a paintball gun coupled to the paintball hopper is being used.

In accordance with one aspect of the disclosure, circuitry in communication with the sensor and the light source can be configured to turn on the light source when the paintball gun is being used and turn off the light source when the paintball gun is not being used.

In accordance with one aspect of the disclosure, the light source can include one or more LEDs, UV LEDs, or lasers.

In accordance with one aspect of the disclosure, the light source can be configured to be removably coupled to the hopper tray.

In accordance with one aspect of the disclosure, the hopper tray, can include one or more light windows positioned over the light source. The one or more light windows can be removably coupled to the hopper tray.

In accordance with one aspect of the disclosure, the hopper tray can include a user interface wherein the user interface can be configured to control one or more functions of the light source and/or one or more functions of an electronic feed system.

BRIEF DESCRIPTION OF THE DRAWINGS

Various embodiments are depicted in the accompanying drawings for illustrative purposes and should in no way be interpreted as limiting the scope of the embodiments. Furthermore, various features of different disclosed embodiments can be combined to form additional embodiments, which are part of this disclosure.

DETAILED DESCRIPTION

Figure 1A:
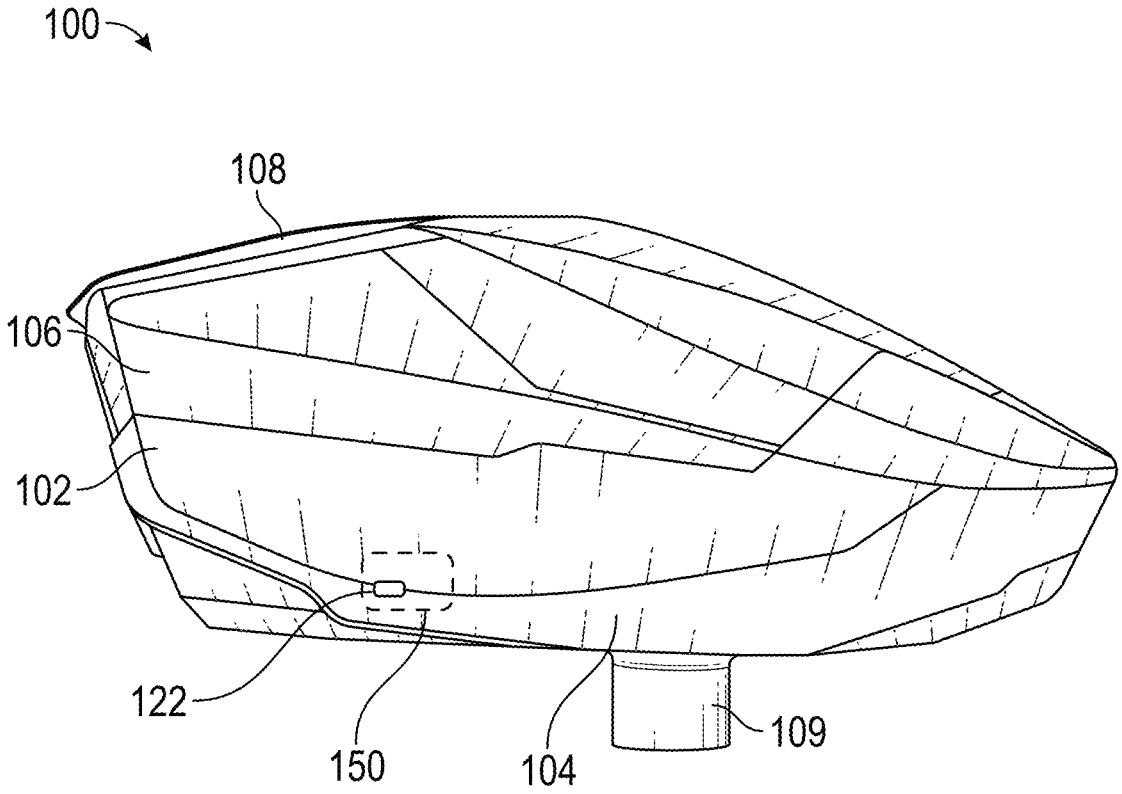
FIG. 1A illustrates a hopper for a paintball gun.

Although several embodiments, examples, and illustrations are disclosed below, it will be understood by those of ordinary skill in the art that the system, methods, and devices described herein extend beyond the specifically disclosed embodiments, examples, and illustrations and includes other uses of the system, methods, and devices and obvious modifications and equivalents thereof. Embodiments of the disclosure are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the disclosure. In addition, embodiments of the disclosure can include several novel features and no single feature is solely responsible for its desirable attributes or is essential to practicing the system, methods, and devices herein described.

FIGS. 1A-1D illustrate a hopper 100 for a paintball gun. The hopper 100 may be removably coupled to a paintball gun or paintball marker. The hopper 100 may supply or transfer paintballs to the paintball gun. The hopper 100 may be a gravity fed hopper and/or an electronic fed hopper. The hopper 100 may include a housing 102. The housing 102 may define an inner volume 130 that may store or house a plurality of paintballs. The housing 102 may be made of a plastic, polypropylene, polyvinyl chloride (PVC), polyethylene, acrylonitrile butadiene styrene (ABS), carbon fiber, nylon, reinforced nylon, metal (e.g., aluminum) and/or any other suitable material. In some embodiments, the housing 102 may be transparent or semitransparent.

In some embodiments, the housing 102 may include a body 104 and a cover 106 (e.g., that together define the housing 102). In some embodiments, the cover 106 may be removably coupled to the body 104. The cover 106 may be removably coupled to the body 104 via one or more magnets, clamps, clips, latches, hook and loop fasteners, mechanical fasteners, for example one or more screws, and/or any other fastener. In some embodiments, the cover 106 may be press-fit, snap-fit, and/or friction fit to the body 104. In some embodiments, the cover 106 may be removably coupled to the body 104. In some embodiments, the cover 106 may be rotatably coupled to the body 104. In some embodiments, as shown in FIG. 1C, the cover 106 may include an opening 114 to the inner volume 130 of the housing 102. The opening 114 may receive a plurality of paintballs so a user may insert the plurality of paintballs into the inner volume 130 of the housing 102 via the opening 114. The cover 106 may include a lid 108 pivotably coupled to the cover 106 over the opening 114. The lid 108 may pivot between a closed position and an open position. When the lid 108 is in the closed position, the lid 108 may cover the opening 114 to prevent or inhibit paintballs from exiting or falling out of the inner volume 130 of the housing 102 via the opening 114. When the lid 108 is in the open position, the lid 108 may uncover the opening 114 to allow ingress of paintballs into the inner volume 130 of the housing 102 via the opening 114.

The hopper 100 may include a neck 109. The neck 109 may extend from the body 104 of the hopper 100. As shown in FIG. 1B, the neck 109 may include a conduit 110. The conduit 110 may extend from an inner surface 105 of the body 104 to a distal end 111 of the neck 109. The neck 109 may be removably coupled to a paintball gun or paintball marker so the conduit 110 aligns with a paintball receiving portion of a paintball gun or paintball marker. Thus, when the neck 109 and/or the hopper 100 is coupled to the paintball gun or paintball marker, paintballs in the inner volume 130 of the housing 102 may travel from the inner volume 130 of the housing 102 into the paintball gun or paintball marker through the conduit 110 of the neck 109.

Figure 1B:
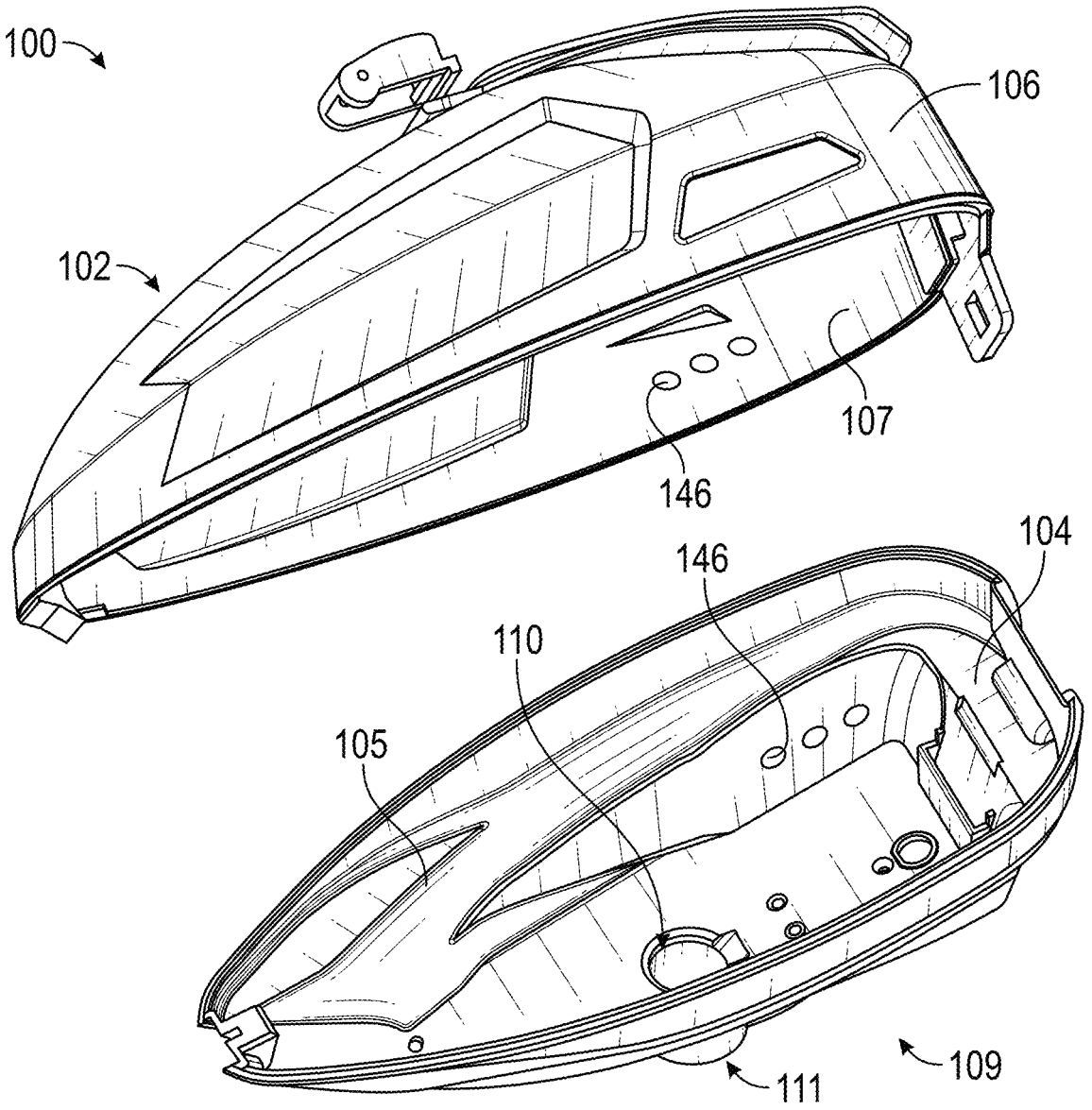
FIG. 1B illustrates the hopper of FIG. 1A with a cover of the hopper removed from a base of the hopper.
Figure 1C:
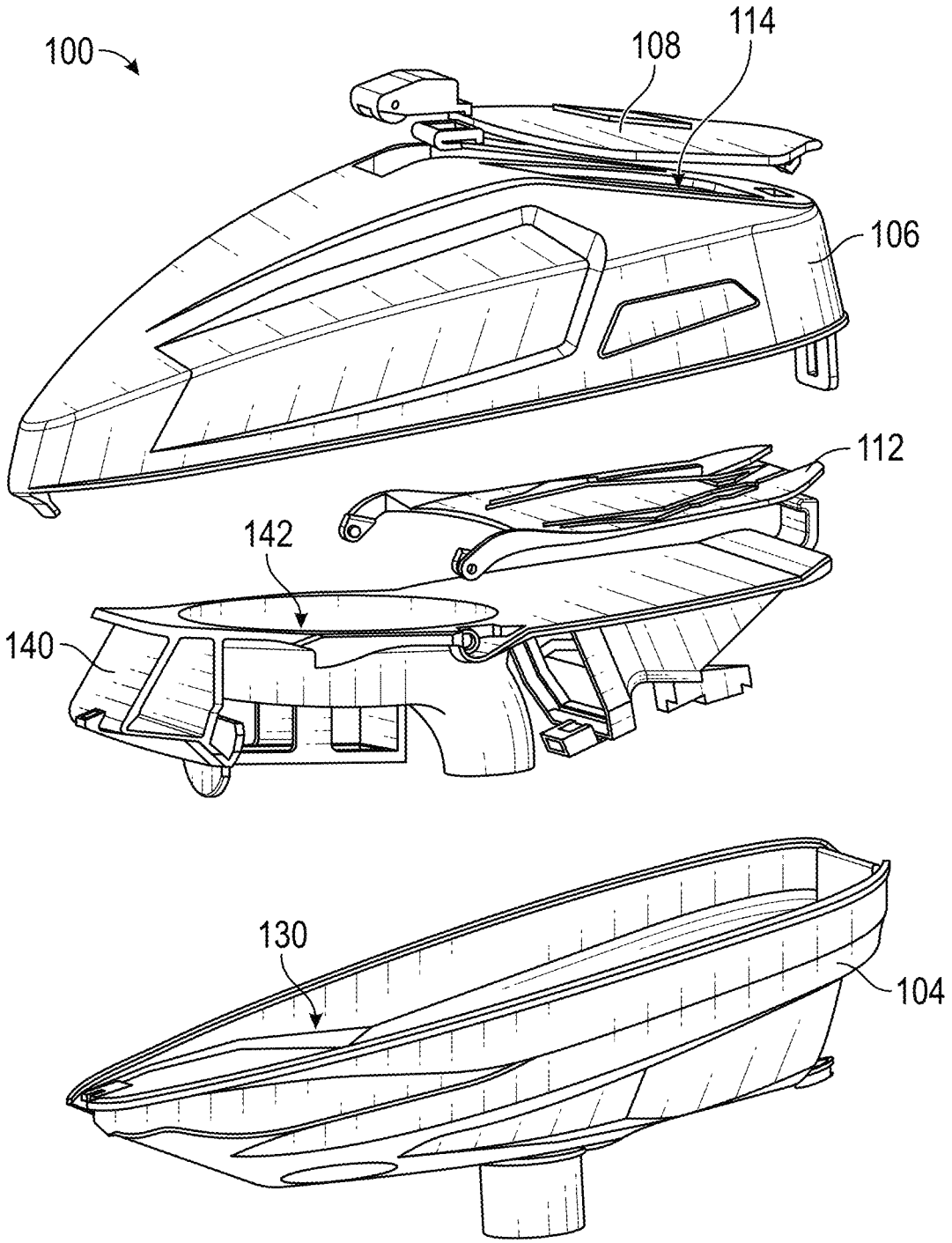
FIG. 1C illustrates an exploded view of the hopper of FIG. 1A with a hopper tray.

As shown in FIG. 1A, in some embodiments, the hopper 100 may include a power source 150. The power source 150 may be a battery (e.g., rechargeable battery or replaceable battery). The power source 150 may provide power to a feed system of the hopper 100, one or more lights or indicators, and/or any other parts or components of the hopper 100.

In some embodiments, the hopper 100 may include a port 122. The port 122 may connect the hopper 100 to an external power source (i.e., a wall outlet, an external battery, etc.) via a wired and/or a wireless connection. The port 122 may include a Universal Serial Bus (USB), USB Type A, USB Type B, USB Type C, Mini-USB, Micro-USB, a coaxial power connector (i.e., a barrel connector), and/or any other port. In some embodiments, the port 122 may include one or more induction coils for wireless power transfer to the hopper from the external power source via induction. The power source 150 may receive power from the external power source via the port 122.

Figure 1D:
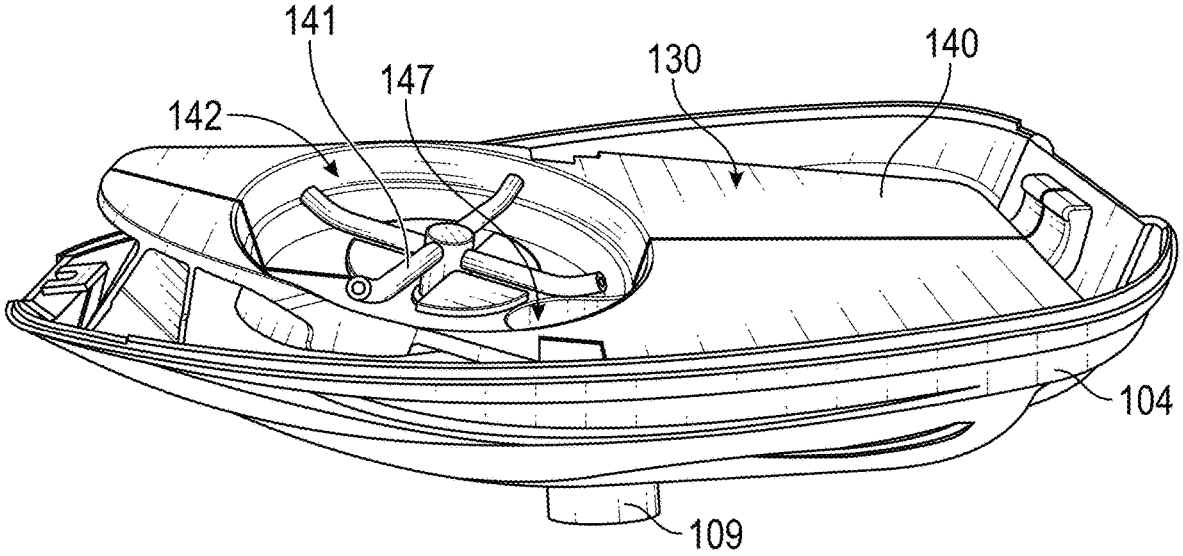
FIG. 1D illustrates a hopper tray positioned in the base of the hopper of FIG. 1A.

As shown in FIG. 1C, the hopper 100 may include a hopper tray 140. The hopper tray 140 may include a feed system 141 (see FIG. 1D) of the hopper 100. The hopper tray 140 may be removably inserted into the inner volume 130 of the housing 102. The hopper tray 140 may be removably inserted into the inner volume 130 when the cover 106 is decoupled or removed from the body 104. As shown in FIG. 1D, when the hopper tray 140 is inserted into the inner volume 130, the hopper tray 140 may be positioned in the body 104 of the housing 102 so an opening 147 in the hopper tray 140 aligns with the neck 109. In some embodiments, the hopper tray 140 may be removably coupled to the housing 102 and/or the body 104. The hopper tray 140 may be coupled to the housing 102 and/or the body 104 via one or more magnets, clamps, clips, latches, spring loaded latches, hook and loop fasteners, mechanical fasteners, for example one or more screws, and/or any other fastener. In some embodiments, the hopper tray 140 may be press-fit, snap-fit, and/or friction fit to the housing 102 and/or the body 104. In some embodiments, the hopper tray 140 may be coupled to the housing 102 and/or the body 104 via lockable ledge.

In some embodiments, the hopper 100 may include a ramp portion 112 coupled to the hopper tray 140. The ramp portion 112 may direct paintballs in the inner volume 130 of the hopper 100 towards a recess 142 or raceway bowl of the hopper tray 140.

In some embodiments, as shown in FIG. 1B, the hopper 100 may include a light source 146 positioned on the inner surface 105 of the body 104 and/or an inner surface 107 of the cover 106. The light source 146 may be or include a light source 246 as described below with reference to FIGS. 2A-2C (e.g., light source 146 may be one or more LEDs, UV LEDs, or lasers).

Figure 2A:
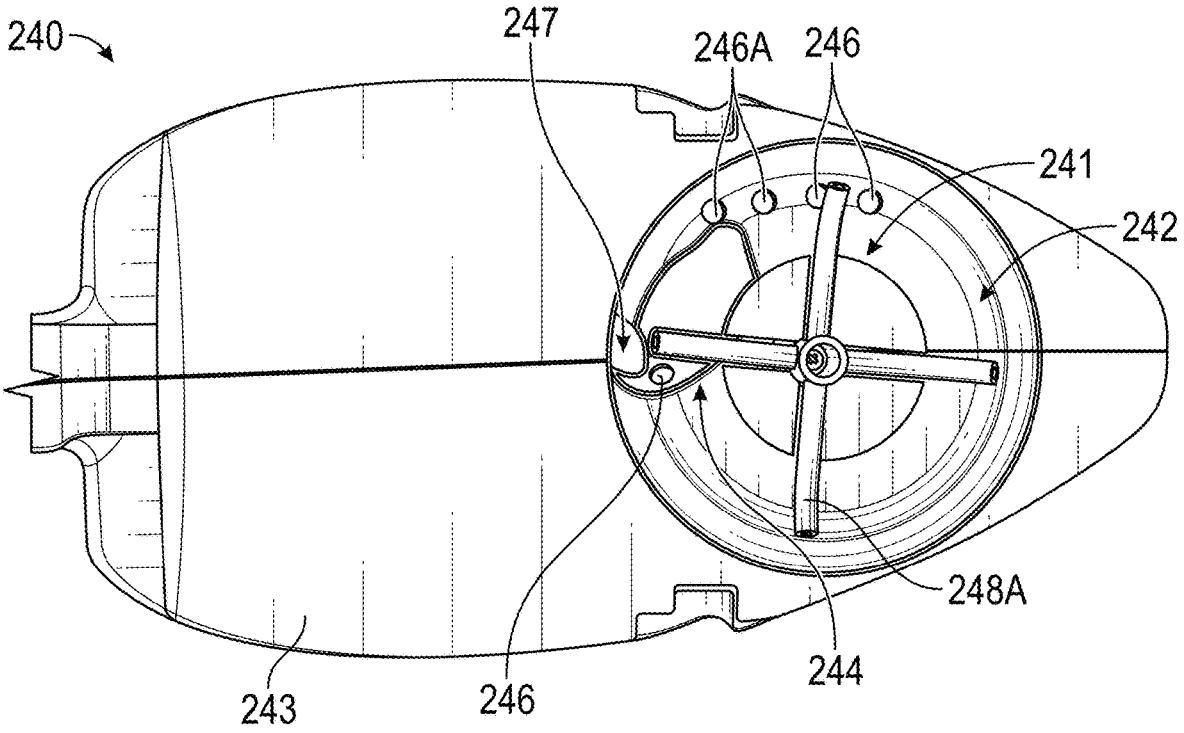
FIG. 2A illustrates a top view of a hopper tray for a hopper.
Figure 2B:
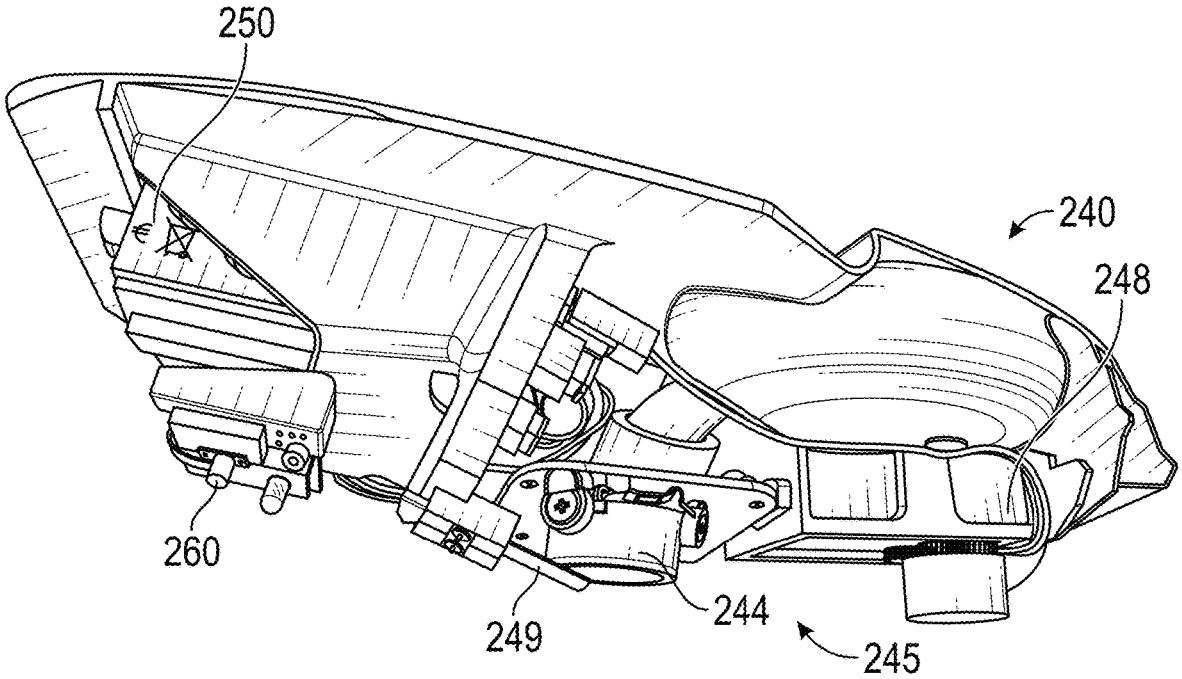
FIG. 2B illustrates a side view of the hopper tray of FIG. 2A.
Figure 2C:
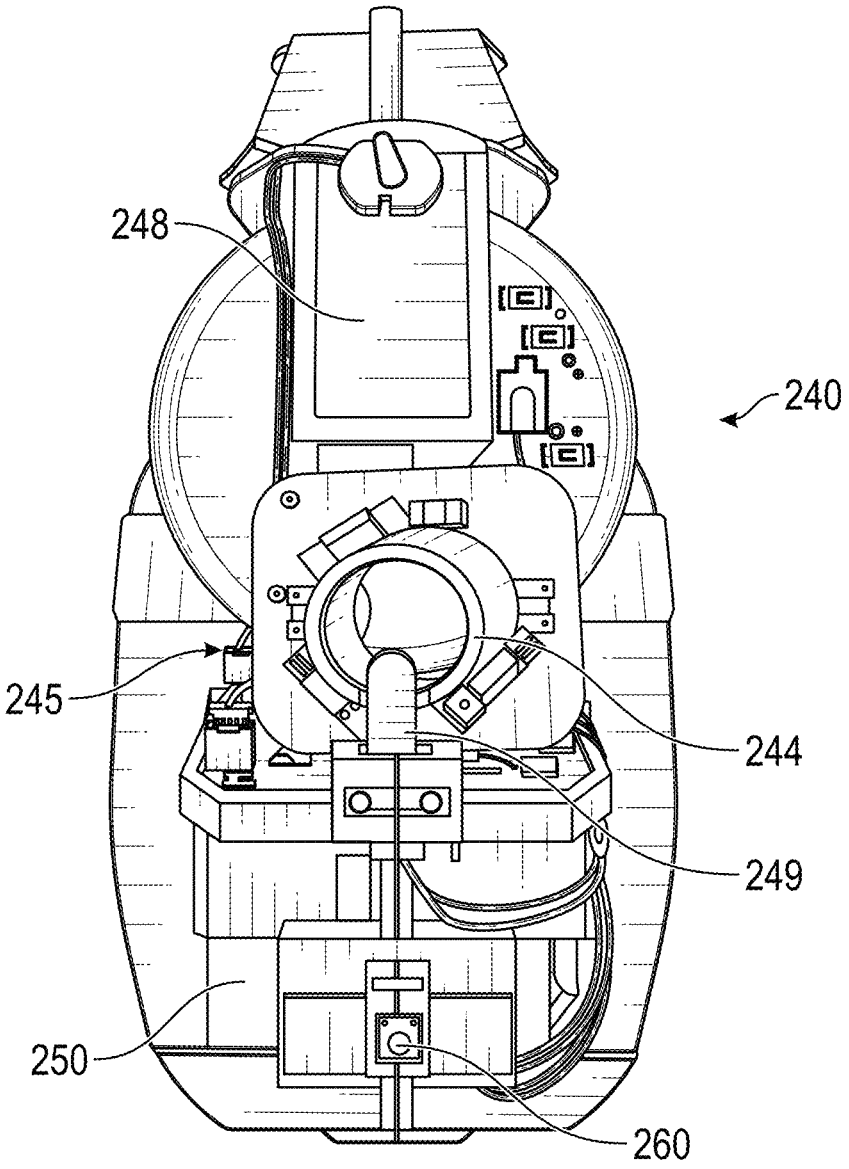
FIG. 2C illustrates a bottom view of the hopper tray of FIG. 2A/

FIGS. 2A-2C illustrate a hopper tray 240 for a hopper (such as hopper 100). The hopper tray 240 may include a feed system 241. The feed system 241 may include a recess 242 or raceway bowl and a conduit 244 that extends from an opening 247 in the recess 242 or raceway bowl. The recess 242 may be circle shaped, oval shaped, ellipse shaped, and/or any other shape. The recess 242 may extend into the hopper tray 240 from a top surface 243 of the hopper tray 240. The top surface 243 of the hopper tray 240 may be a surface of the hopper tray 240 that faces a cover (e.g., cover 106) of the hopper (e.g., hopper 100) when the hopper tray 240 is positioned in an inner volume of the hopper. Accordingly, when the hopper tray 240 is positioned in the hopper, paintballs in the inner volume of the hopper may be positioned between the top surface 243 of the hopper tray 240 and the cover of the hopper. The conduit 244 may extend from the opening 247 in the recess 242 through the hopper tray 240 to a bottom 245 of the hopper tray 240.

The conduit 244 and/or the recess 242 may be positioned in the hopper tray 240 so the conduit 244 aligns with a conduit of the hopper (e.g., conduit 110 of hopper 100) when the hopper tray 240 is positioned in the inner volume of the hopper. Accordingly, paintballs in the inner volume of the hopper may enter or fall into the recess 242 or raceway bowl and pass through the hopper tray 240 via the opening and conduit 244 and into a conduit of the hopper (e.g., conduit 110 of hopper 100).

In some embodiments, the feed system 241 may direct or push paintballs in the recess 242 towards and/or through the opening and conduit 244. The feed system 241 may include an actuator 248. In some embodiments, the feed system 241 may include one or more paddles 248A. The feed system 241 may include one (1) paddle 248A, two (2) paddles 248A, three (3) paddles 248A, four (4) paddles 248A, five (5) paddles 248A, six (6) paddles 248A, seven (7) paddles 248A, and/or eight (8) paddles 248A. In some embodiments, the feed system 241 may include more than eight (8) paddles 248A. The paddles 248A may be positioned in the recess 242 or raceway bowl. The paddles 248A may be movably coupled to the recess 242 at a center of the recess 242 so the paddles 248A extends radially outward from the center of the recess. The paddles 248A may be rotatably coupled to the recess 242 so the paddles 248A rotate or spin around the center of the recess 242. The actuator 248 may rotate or spin the paddles 248A within the recess 242 or raceway bowl. Accordingly, when paintballs enter or fall into the recess 242 the paddles 248A may rotate or spin to direct or push the paintballs towards the opening and conduit 244. In one example, the actuator 248 can be an electric motor.

In some embodiments, the hopper tray 240 may include a light source 246. The light source 246 may charge paintballs that are made of, or include, a luminescent or glow in the dark material. The light source 246 may charge the luminescent or glow in the dark material as the paintballs travel through the hopper and/or the hopper tray 240. The luminescent or glow in the dark material may absorb light of the light source 246 as the paintballs pass through the hopper, the hopper tray 240, the recess 242 and/or the conduit 244. In some embodiments, the light source 246 may cause the hopper, the hopper tray 240, and/or the feed system 241 (e.g., the paddles 248A) to glow (as shown for example in FIG. 1D). The luminescent or glow in the dark material may be charged by being exposed to the light source 246.

The light source 246 may be one or more LEDs, UV LEDs, or lasers. However, other suitable light types can be used. In some embodiments, light from the light source 246 may be visible to the user. In some embodiments, light from the light source 246 may not be visible by the user. In some embodiments, the light source 246 may emit UV light (e.g., light with a wavelength of 200 nm to 400 nm). The UV light may charge the paintballs more quickly than a visible light source (e.g., light with a wavelength of 380 nm to 750 nm). Furthermore, in some embodiments, the light source 246 may provide both UV light and visible light, or only provide visible light.

In some embodiments, the light source 246 may be positioned in the recess 242 or raceway bowl (e.g., disposed in a surface of the recess 242 or raceway bowl). Alternatively, the light source 246 may be positioned on the top surface 243 of the hopper tray 240, in the conduit 244, and/or in the feed system 241 (e.g., on or in the paddles 248A). In some embodiments, the light source 246 may be positioned so the light source 246 emits light into the recess 242, the conduit 244, and/or the inner volume of the hopper.

In some embodiments, the light source 246 may be positioned in the hopper tray 240 so the light source 246 aligns with one or more openings in the hopper tray 240. The hopper tray may include light windows 246A. The light windows 246A may be transparent or semitransparent. The light windows 246A may be positioned over the one or more openings in the hopper tray 240 so the light windows 246A cover the one or more openings and/or the light source 246. Accordingly, the light source 246 may emit light through the light windows 246A. In some embodiments, the light windows 246A may be colored or tinted so the light windows 246A modify, alter, or change a color of the light from the light source 246.

The light windows 246A may protect the light source 246. The light windows 246A may prevent or inhibit paintballs, dirt, paint, debris, and/or water from contacting or damaging the light source 246. For example, if a paintball breaks when the paintball is in the hopper or the recess 242, the light windows 246A may prevent or inhibit paint in the paintball from contacting or damaging the light source 246. The light windows 246A may allow a user to more easily clean the hopper tray 240.

In some embodiments, the light windows 246A may be removably coupled to the hopper tray 240 and/or the light source 246. The light windows 246A may be removably coupled to the hopper tray 240 via one or more magnets, clamps, clips, latches, hook and loop fasteners, mechanical fasteners, for example one or more screws, and/or any other fastener. In some embodiments, the light windows 246A may be press-fit, snap-fit, and/or friction fit to the hopper tray 240. Accordingly, a user may remove the light windows 246A to clean the light windows 246A and/or replace the light windows 246A with new light windows 246A. For example, a paintball may scratch or otherwise damage a light window 246A and a user may replace the damaged light window 246A with a new light window 246A that is not damaged.

In some embodiments, at least a portion of the hopper tray 240 and/or the feed system 241 may be transparent and/or semitransparent. In some embodiments, the top surface 243, the recess 242, the conduit 244, the electronic feed system 241 (e.g., the paddles 248A), and/or any other portion of the hopper tray 240 may be transparent and/or semitransparent. The light source 246 may be positioned in the hopper tray 240 so the light source 246 emits light through transparent and/or semitransparent portion of the hopper tray 240.

The light source 246 may be coupled to the hopper tray 240 via one or more magnets, clamps, clips, latches, hook and loop fasteners, glue, adhesive, adhesive tape, mechanical fasteners, for example one or more screws, and/or any other fastener. In some embodiments, the light source 246 may be press-fit, snap-fit, and/or friction fit to the hopper tray 240. In some embodiments, the light source 246 may be removably coupled to the hopper tray 240. Accordingly, a user may remove the light source 246 to clean the light source 246 and/or replace a damaged light source 246 with a new light source 246.

In some embodiments, as shown in FIGS. 2B and 2C, the hopper tray 240 may include a sensor 249. In some embodiments, the hopper tray 240 may include multiple sensors 249. The sensor 249 may determine when a user is using the paintball gun or marker. In some embodiments, the sensor 249 may determine the user is using the paintball gun or marker when the sensor 249 detects a paintball is in the recess 242, in the conduit 244, and/or passes through the conduit 244. In some embodiments, the sensor 249 may be a motion sensor, pressure sensor, a proximity sensor, a light sensor, and/or vibration sensor. For example, the vibration sensor may detect that a user is using the paintball gun or marker when the vibration sensor detects vibration. In some embodiments, circuitry in communication with the sensor 249, the power source 250, and/or the light source 246 may turn on the light source 246 (e.g., automatically, without user input) when the sensor 249 detects or determines the user is using the paintball gun or marker. In some embodiments, circuitry in communication with the sensor 249, the power source 250, and/or the light source 246 may turn off the light source 246 (e.g., automatically, without user input) when the sensor 249 detects or determines that the user is not using the paintball gun or marker. Accordingly, the sensor 249 may reduce or minimize an amount of power used by the light source 246.

In some embodiments, as shown in FIG. 2B, the hopper tray 240 may include a power source 250. The power source 250 may include the power source 150 of the hopper 100, as described above with reference to FIGS. 1A-1D. In some embodiments, the power source 250 may provide power to the feed system 241 (i.e., the actuator 248) and/or the light source 246. In some embodiments, the power source 250 may be a battery (e.g., rechargeable battery or replaceable battery). The power source 250 may be coupled to and/or integrated in the hopper tray 240.

In some embodiments, as shown in FIG. 2C, the hopper tray 240 may include a user interface 260. The user interface 260 may receive a user input from a user. In some embodiments, the user interface 260 may include one or more buttons (i.e., physical inputs). The user interface 260 may control one or more functions of the hopper tray 240, the feed system 241, and/or the light source 246. The user interface 260 may power on/off the feed system 241 and/or the light source 246. The user interface 260 may change a color of the light from the light source 246, increase and/or decrease a brightness of the light from the light source 246, a wavelength of the light from the light source 246, cause light source 246 to flash or pulse, and/or otherwise modify or change the light from the light source 246. In some embodiments, the user interface 260 may include one or more buttons that may control the feed system 241 and one or more buttons that may control the light source 246. In some embodiments, the user interface 260 may include one or more buttons that may control both the feed system 241 and the light source 246. For example, a user may press a button to turn on/off the feed system 241 and the user may press and hold the button (e.g., a Deadman switch) to turn on/off the light source 246.

Figure 3A:
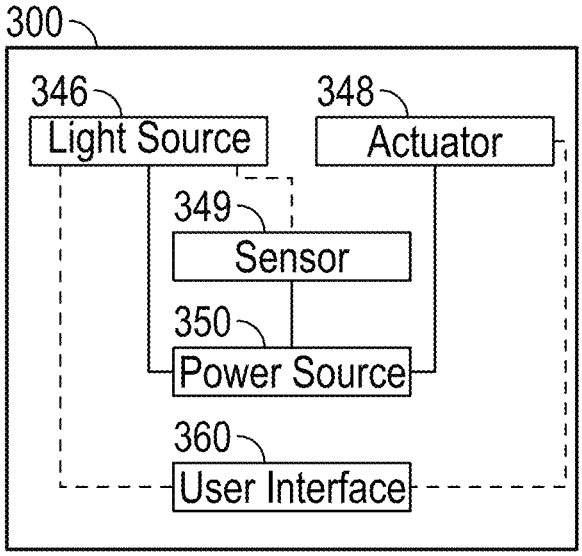
FIG. 3A illustrates a schematic view of components of a hopper for a paintball gun.
Figure 3B:
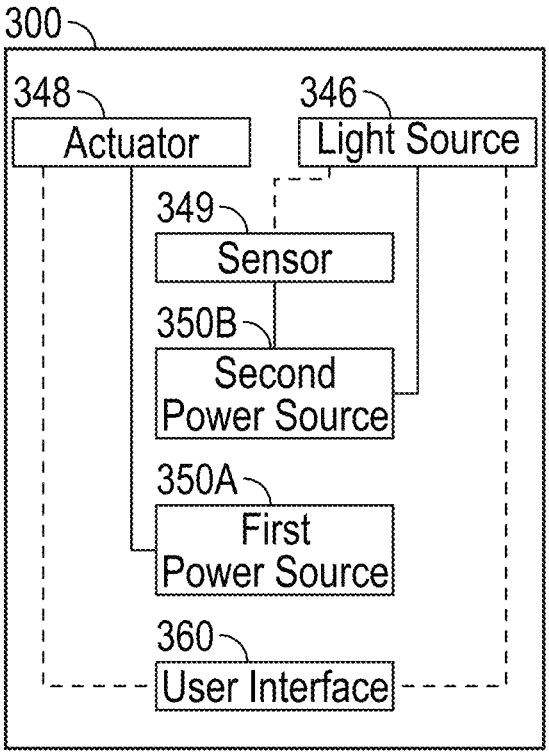
FIG. 3B illustrates a schematic view of components of another hopper for a paintball gun.

FIGS. 3A and 3B illustrate schematics of components of a hopper 300. The hopper 300 may include hopper 100, as described with reference to FIGS. 1A-1D. As shown in FIG. 3A, the hopper 300 may include a power source 350, a light source 346, a sensor 349, an actuator 348, and/or a user interface 360. The power source 350 may include the power source 150 of hopper 100, as described with reference to FIGS. 1A-1D and/or the power source 250 of hopper tray 240, as described with reference to FIGS. 2A-2C. In some embodiments, the power source 350 may be coupled to or positioned in a housing of the hopper 300 or a hopper tray of the hopper 300. The power source 350 may provide power to the light source 346, the sensor 349, and/or the actuator 348. The actuator 348 may include actuator 248 of the feed system 241 of hopper tray 240, as described with reference to FIG. 2A-2C. The actuator 348 may control the transfer or supply of paintballs from an inner volume of the hopper 300 through the hopper tray and into the paintball gun. The user interface 360 may receive one or more user inputs or selections. The user interface 360 may control one or more functions or features of the light source 346 and/or the actuator 348 (e.g., can operate the light source 346 and actuator 348 simultaneously or independent of each other, actuating one without actuating the other). The light source 346 may include light source 246 and/or light source 146.

As shown in FIG. 3B, in some embodiments, the hopper 300 may include a first power source 350A and a second power source 350B (e.g., that is separate from the first power source 350A, such as a separate battery). The first power source 350A may provide power to the actuator 348. The second power source 350B may provide power to the light source 346 and/or the sensor 349.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. For example, the structure and operation described above for light source 246 is understood to apply to the light source 146, the structure an operation of the electronic feed system 241 is understood to apply to the electronic feed system 141. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A paintball hopper for a paintball gun, the paintball hopper comprising:

a housing that forms an inner volume; and a hopper tray comprising a recess extending from a top surface of the hopper tray, an electronic feed system positioned in the recess, and a first conduit extending from the recess through the hopper tray, and an integrated light source positioned in the recess so the light source emits light into the recess and the first conduit, the integrated light source configured to charge a luminescent material of paintballs in the inner volume of the housing, wherein the hopper tray is configured to removably couple to the housing so the hopper tray is removably positioned in the inner volume and the first conduit is aligned with a second conduit of a feed neck of the housing.

2. The paintball hopper of claim 1, wherein at least a portion of the hopper tray is transparent or semitransparent.

3. The paintball hopper of claim 1, further comprising a power source configured to provide power to the integrated light source and/or the electronic feed system.

4. The paintball hopper of claim 1, further comprising a user interface, wherein the user interface is configured to control one or more functions of the integrated light source and/or one or more functions of the electronic feed system.

5. The paintball hopper of claim 1, wherein the integrated light source comprises one or more LEDs, UV LEDs, or lasers.

6. The paintball hopper of claim 1, further comprising one or more light windows positioned over the integrated light source.

7. The paintball hopper of claim 1, further comprising one or more sensors configured to detect when the paintball gun is being used, and wherein circuitry in communication with the one or more sensors and the light source is configured to control one or more functions of the integrated light source when the one or more sensors detects the paintball gun is being used.

8. The paintball hopper of claim 1, wherein the light source comprises a plurality of lights and a first light of the plurality of lights is positioned in the first conduit of the hopper tray.

9. The paintball hopper of claim 1, wherein the hopper tray extends from a proximal end to a distal end, and wherein the recess is positioned at the distal end of the hopper tray so the recess is positioned distal to the second conduit when the hopper tray is positioned in the housing.

10. The paintball hopper of claim 1, wherein the first conduit extends from an opening in the recess.

11. The paintball hopper of claim 1, wherein the hopper further comprises a ramp portion coupled to the hopper tray, wherein the ramp portion is configured to direct paintballs in the inner volume towards the recess.

12. The paintball hopper of claim 1, wherein the light source is configured to cause paddles of the electronic feed system to glow.

13. A hopper tray for a paintball hopper, the hopper tray comprising:

a recess extending into the hopper tray from a top surface;

an electronic feed system positioned in the recess;

a conduit extending through the hopper tray from the recess to a bottom of the hopper tray; and a light source positioned in the recess so the light source emits light into the recess and the conduit, wherein the light source is configured to charge a luminescent material of paintballs in the paintball hopper, wherein the hopper tray is configured to removably couple to the paintball hopper so the hopper tray is removably positioned in an inner volume of the paintball hopper, wherein the conduit is configured to align with a conduit of the paintball hopper when the hopper tray is positioned in the inner volume of the paintball hopper.

14. The hopper tray of claim 13, wherein at least a portion of the hopper tray is transparent or semitransparent.

15. The hopper tray of claim 13, wherein the electronic feed system is configured to direct paintball in the recess towards the conduit.

16. The hopper tray of claim 13, further comprising a sensor configured to detect when a paintball gun coupled to the paintball hopper is being used.

17. The hopper tray of claim 16, wherein circuitry in communication with the sensor and the light source is configured to turn on the light source when the paintball gun is being used and turn off the light source when the paintball gun is not being used.

18. The hopper tray of claim 13, wherein the light source comprises one or more LEDs, UV LEDs, or lasers.

19. The hopper tray of claim 13, wherein the light source is configured to be removably coupled to the hopper tray.

20. The hopper tray of claim 13, further comprising one or more light windows positioned over the light source, wherein the one or more light windows are removably coupled to the hopper tray.

21. The hopper tray of claim 13, further comprising a user interface wherein the user interface is configured to control one or more functions of the light source and/or one or more functions of the electronic feed system.

* * * * *